US011827020B2

(12) United States Patent
Okushima et al.

(10) Patent No.: US 11,827,020 B2
(45) Date of Patent: Nov. 28, 2023

(54) LIQUID EJECTION HEAD

(71) Applicant: CANON KABUSHIKI KAISHA, Tokyo (JP)

(72) Inventors: Shingo Okushima, Kanagawa (JP); Yumi Komamiya, Kanagawa (JP); Satoshi Oikawa, Kanagawa (JP); Satoshi Kimura, Kanagawa (JP); Hirotomo Taniguchi, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 17/530,295

(22) Filed: Nov. 18, 2021

(65) Prior Publication Data

US 2022/0161560 A1 May 26, 2022

(30) Foreign Application Priority Data

Nov. 26, 2020 (JP) ..... 2020-196092
Mar. 24, 2021 (JP) ..... 2021-050143

(51) Int. Cl.
*B41J 2/16* (2006.01)
*B41J 2/14* (2006.01)

(52) U.S. Cl.
CPC ..... *B41J 2/1623* (2013.01); *B41J 2/1604* (2013.01); *B41J 2002/14491* (2013.01)

(58) Field of Classification Search
CPC ..... B41J 2/1623; B41J 2/1604; B41J 2002/14491; B41J 2202/08; B41J 2/1601; B41J 2/14072
See application file for complete search history.

(56) References Cited

U.S. PATENT DOCUMENTS

2008/0143784 A1* 6/2008 Ono ..... B41J 2/14024 347/44
2015/0343777 A1* 12/2015 Seki ..... B41J 2/14072 347/50

FOREIGN PATENT DOCUMENTS

JP 2017205903 A 11/2017

OTHER PUBLICATIONS

Characterization and properties of high-temperature resistant structure adhesive based on novel toughened bismaleimide resins, [retrieved on Mar. 23, 2023], p. 7, section under Fig. 11 (Year: 2021).*

(Continued)

*Primary Examiner* — Lisa Solomon
(74) *Attorney, Agent, or Firm* — Canon U.S.A., Inc. I.P. Division

(57) ABSTRACT

A liquid ejection head including a recording element substrate for ejecting liquid supported by a support member with an adhesive layer provided between the recording element substrate and the support member. A terminal is provided at an end portion of the recording element substrate with a sealing member covering the end portion of the recording element substrate including the terminal. The sealing member is in contact with a side surface of the end portion and an end surface of the adhesive layer. The adhesive layer comprises includes a first adhesive portion and a second adhesive portion positioned between the first adhesive portion and the sealing member. Rigidity of the second adhesive portion is less than the rigidity of the sealing member and less than the rigidity of the first adhesive portion.

19 Claims, 7 Drawing Sheets

(56) References Cited

OTHER PUBLICATIONS

Mechanical Properties of Composites Used in High-Voltage Applications, [retrieved on Mar. 23, 2023], p. 6, section 3.2. Application of Tensile Tests on Epoxy Based Materials, Fig. 2 (Year: 2016).*
IP.com search (Year: 2023).*

* cited by examiner

FIG. 4A

| | FIRST ADHESIVE AGENT | SECOND ADHESIVE AGENT | SEALING MEMBER | AUXILIARY ADHESIVE AGENT |
|---|---|---|---|---|
| | RESIN ABOUT 30%<br>SILICA FILLERS ABOUT 70% | RESIN ABOUT 95% | RESIN ABOUT 30%<br>SILICA FILLERS ABOUT 70% | RESIN ABOUT 95% |
| CURING | EPOXY CATIONIC | EPOXY CATIONIC | EPOXY CATIONIC | EPOXY CATIONIC |
| ELASTIC MODULUS GPa AT 25°C | 13.6 | 2.9 | 13.6 | 2.9 |
| CURE SHRINKAGE % | 1.0 | 2.3 | 1.0 | 2.3 |
| CTE ppm/°C (BELOW Tg) | 20 | 90 | 20 | 90 |

FIG. 4B

| | EXAMPLE | FIRST COMPARATIVE EXAMPLE | SECOND COMPARATIVE EXAMPLE |
|---|---|---|---|
| 50 CYCLES | 5/5 OK | 2/5 OK<br>3/5 NG | 5/5 NG |
| 60 CYCLES | 5/5 OK | 2/2 NG | |
| 70 CYCLES | 5/5 OK | | |
| 80 CYCLES | 5/5 OK | | |
| 90 CYCLES | 5/5 OK | | |
| 100 CYCLES | 5/5 OK | | |

LIQUID EJECTION HEAD

BACKGROUND

Field of the Disclosure

The present disclosure generally relates to a liquid ejection head for ejecting liquid such as ink.

Description of the Related Art

Japanese Patent Application Laid-Open No. 2017-205903 discloses a liquid ejection head having a recording element substrate provided with an energy generating element for generating ejection energy. The recording element substrate is fixed to the support member with an adhesive agent. The end portion of the electric wiring substrate is fixed to the support member so as to be adjacent to the end portion of the recording element substrate. Electrically connecting portions are provided on the end portions of the electric wiring substrate and the recording element substrate, and the electrically connecting portions are electrically connected by an electrically connecting member such as a wire bonding. The entire portion including the electrically connecting portion of the electric wiring substrate, the electrically connecting portion of the recording element substrate, and the electrically connecting member is covered with a sealing member such as resin.

In the above liquid ejection head, a sealing member having higher rigidity is used in order to obtain a higher insulation property or to prevent liquid penetration. Also, an adhesive agent with higher rigidity is used to enhance adhesiveness.

However, in the liquid ejection head disclosed in Japanese Patent Application Laid-Open No. 2017-205903 with a sealing member or adhesive agent having high rigidity, strong stress occurs in the contact surface between the sealing member and the recording element substrate and the support member when a temperature change occurs because the coefficient of thermal expansion of the recording element substrate and that of the support member are different. As a result, a crack may occur in the recording element substrate which has a lower mechanical strength than the support member.

SUMMARY

Aspects of the present disclosure provide a liquid ejection head capable of suppressing the occurrence of cracking in the recording element substrate.

A liquid discharge head of the present disclosure features a liquid ejection head with a recording element substrate for ejecting liquid and a support member for supporting the recording element substrate. An adhesive layer is provided between the recording element substrate and the support member. A first electrically connecting portion is provided at an end portion of the recording element substrate, and a sealing member covers the end portion of the recording element substrate including the first electrically connecting portion. Wherein the sealing member is in contact with a side surface of the end portion of the recording element substrate and an end surface of the adhesive layer, and the adhesive layer includes a first adhesive portion and a second adhesive portion which is positioned between the first adhesive portion and the sealing member. Wherein the rigidity of the second adhesive portion is less than the rigidity of the sealing member and also less than the rigidity of the first adhesive portion.

Further features of the present disclosure will become apparent from the following description of exemplary embodiments with reference to the attached drawings.

BRIEF DESCRIPTION OF THE DRAWINGS

FIGS. 4A and 4B are tables for explaining the result of comparing the susceptibility to crack between the liquid ejection head shown in FIGS. 2A to 2C and the liquid ejection heads of the comparative examples shown in FIGS. 3A and 3B.

DESCRIPTION OF THE EMBODIMENTS

Hereinafter, an embodiment of the present disclosure will be described in detail with reference to the accompanying drawings. In the attached drawings, the same numbers are given to the components having the same functions, and the description thereof may be omitted. The components described in the embodiments are merely illustrative, and the scope of the present disclosure is not limited thereto.

Figure 1:
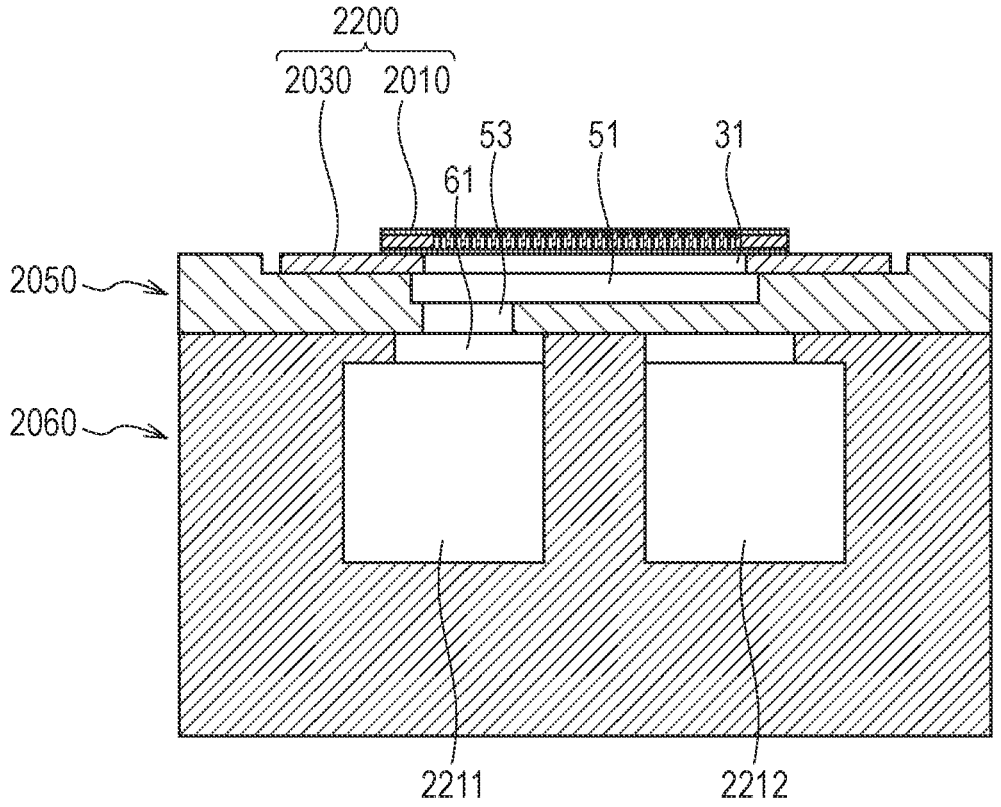
FIG. 1 is a sectional view showing a configuration of a liquid ejection head according to an embodiment of the present disclosure.

FIG. 1 is a sectional view showing a configuration of a liquid ejection head according to an embodiment of the present disclosure.

Referring to FIG. 1, the liquid ejection head of this embodiment includes a liquid ejection module 2200 for ejecting liquid. The liquid ejection module 2200 has a recording element substrate 2010 for ejecting liquid and a support member 2030 for supporting the recording element substrate 2010. The support member 2030 has a communication orifice 31 for supplying liquid to the recording element substrate 2010. Recording element substrate 2010 is fixed to support member 2030 by the adhesive agent.

The liquid ejection module 2200 is provided on a flow passage member in which the first flow passage member 2050 and the second flow passage member 2060 are laminated. The second flow passage member 2060 has a common supply flow passage 2211 and a common collection flow passage 2212. The common supply flow passage 2211 communicates with the liquid communication orifice 31 of the support member 2030 via communication orifices 61, 53 and 51. The liquid is supplied from the common supply flow passage 2211 to the recording element substrate 2010. A part of the liquid supplied to the recording element substrate 2010 is collected to the common collection flow passage 2212 through a communication orifice which is not shown in the figure.

Figure 2A:
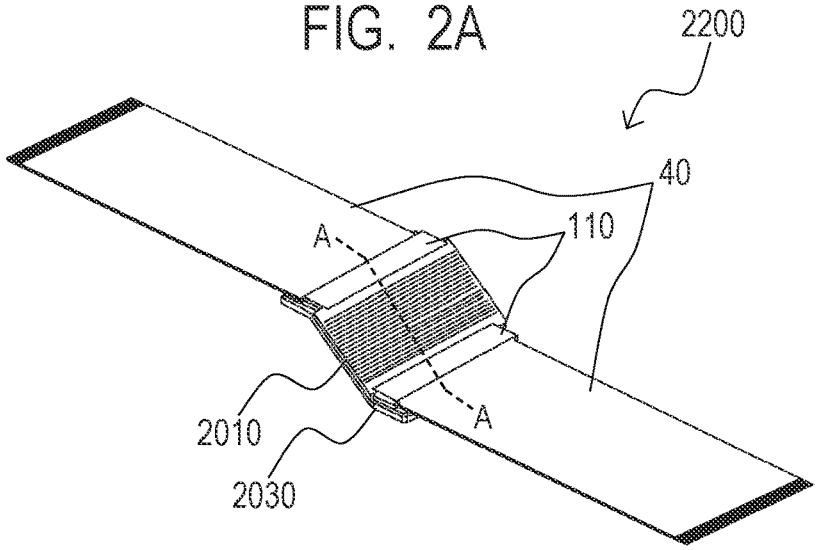
FIGS. 2A, 2B and 2C are perspective views showing the configuration of an ejection module of the liquid ejection head shown in FIG. 1.
Figure 2B:
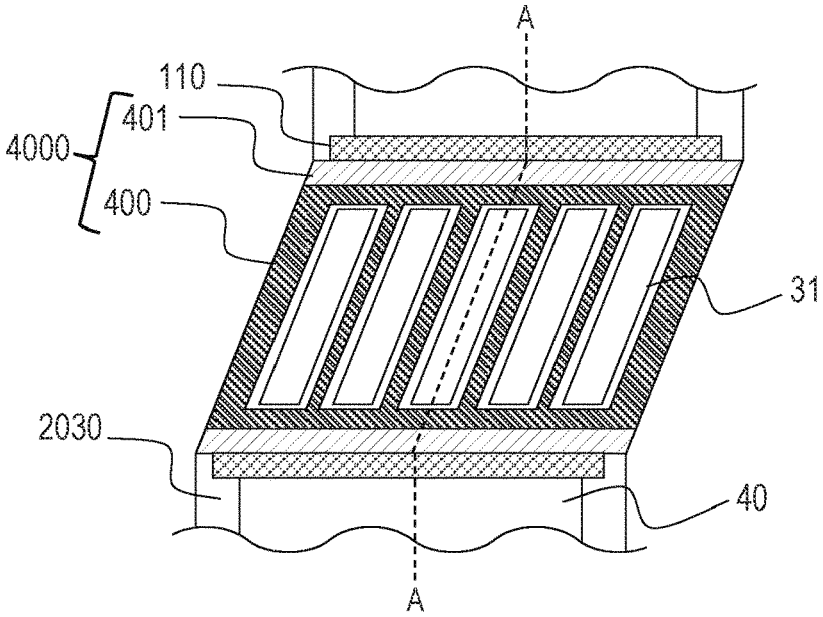
Figure 2C:
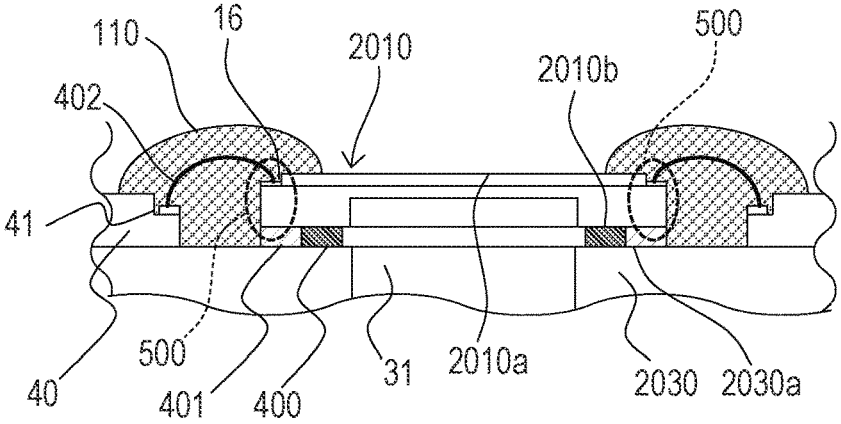

FIGS. 2A to 2C are diagrams for explaining the detailed configuration of the liquid ejection module 2200. FIG. 2A is a schematic view showing a state in which the recording element substrate 2010 and the support member 2030 are bonded. FIG. 2B is a plan view showing an adhesive layer 4000 bonding the recording element substrate 2010 and the support member 2030. FIG. 2C is a sectional view taken along a broken line A-A in FIGS. 2A and 2B.

Referring to FIGS. 2A to 2C, the liquid ejection module 2200 has a recording element substrate 2010, two flexible wiring substrates 40, a support member 2030, an adhesive layer 4000, and sealing members 110. The recording element substrate 2010 includes an ejection surface 2010*a* on which ejection orifices for ejecting liquid are formed. A recording element for generating energy for ejecting liquid is formed at a position facing the ejection orifice. The recording element is, for example, a heating element for foaming liquid by thermal energy. As the recording element substrate 2010, for example, a silicon substrate can be used.

Multiple terminals 16 for driving the recording element are provided in an end portion 500 of the recording element substrate 2010. The terminal 16 is an example of a first electrically connecting portion. In this case, the terminals 16 are arranged at the both end portions in the direction of the row of the ejection orifices of the recording element substrate 2010 (long sides).

The support member 2030 has a support surface 2030*a* for supporting a back surface 2010*b* which is a surface opposite to the ejection surface 2010*a* of the recording element substrate 2010. The adhesive layer 4000 is provided between the recording element substrate 2010 and the support member 2030. The adhesive layer 4000 bonds the back surface 2010*b* of the recording element substrate 2010 to the support surface 2030*a* of the support member 2030.

The sealing member 110 covers at least the end portion 500 of the recording element substrate 2010 including the terminal 16. The sealing member 110 is in contact with the side surface of the end portion 500 of the recording element substrate 2010 and the end surface of the adhesive layer 4000.

The flexible wiring substrate 40 is an example of the wiring substrate. Multiple terminals 41 are formed in the end portion of the flexible wiring substrate 40. The terminal 41 is an example of a second electrically connecting portion. The terminal 16 of the recording element substrate 2010 and the terminal 41 of the flexible wiring substrate 40 are electrically connected through an electrically connecting member 402. The electrically connecting member 402 is, for example, wire bonding. The end portion of the flexible wiring substrate 40 is fixed to the support member 2030 so as to be adjacent to the end portion 500 of the recording element substrate 2010. The sealing member 110 covers the electrically connecting member 402, the end portion of the flexible wiring substrate 40, and the end portion 500 of the recording element substrate 2010. By increasing the rigidity of the sealing member 110, the electrically connecting member 402, the terminal 16 of the recording element substrate 2010 and the terminal 41 of the flexible wiring substrate 40 can be more effectively protected and further protected from corrosion by liquid. As the sealing member 110, for example, a material with high elastic modulus can be used. Here, the elastic modulus is a physical property value indicating the resistance in deformation.

The adhesive layer 4000 has a first adhesive portion 400 consists of a first adhesive agent and a second adhesive portion 401 consists of a second adhesive agent. The second adhesive portion 401 is positioned between the first adhesive portion 400 and the sealing member 110. The contact surface between the second adhesive portion 401 and the sealing member 110 is provided so as to be flush with the side surface of the end portion 500 of the recording element substrate 2010. In order to firmly bond the recording element substrate 2010 and the support member 2030 and to prevent leakage of liquid, a high-strength adhesive agent having strong adhesive force is used as the first adhesive agent. The first adhesive portion 400 is located closer to the opening edge of the liquid communication orifice 31 of the support member 2030 than the second adhesive portion 401. The first adhesive portion 400, which is composed of a high strength adhesive agent, has high rigidity. The rigidity of the second adhesive portion 401 is less than the rigidity of the sealing member 110 and also less than the rigidity of the first adhesive portion 400.

Specifically, the elastic modulus of the second adhesive portion 401 is less than the elastic modulus of the first adhesive portion 400 and also less than the elastic modulus of the sealing member 110. For example, the elastic modulus of second adhesive portion 401 is less than or equal to ⅓ of the elastic modulus of first adhesive portion 400 or sealing member 110. Preferably, the elastic modulus of the first adhesive portion 400 or the sealing member 110 may be 10 GPa or greater, and the elastic modulus of the second adhesive portion 401 may be less than 10 GPa. For example, for the first adhesive portion 400, the second adhesive portion 401, and the sealing member 110, an anionic curing epoxy resin having good adhesiveness can be used. Desirably, as the first adhesive portion 400 and the sealing member 110, a resin having higher rigidity, for example, an acid anhydride curing epoxy resin having 50% or more of silica fillers can be used. For the second adhesive portion 401, an amine-based epoxy resin can be used.

The liquid ejection module 2200 described above may be manufactured by the following procedure. First, the recording element substrate 2010 and the flexible wiring substrates 40 are bonded onto the support member 2030 so that their end portions are adjacent to each other. Next, the terminal 16 of the recording element substrate 2010 and the terminal 41 of the flexible wiring substrate 40 are electrically connected by the electrically connecting member 402. The entire portion including terminals 16, 41 and electrically connecting portion 402 is then sealed with the sealing member 110.

The support member 2030 is a support body for supporting the recording element substrate 2010, and is also a flow passage member for supplying liquid to the recording element substrate 2010 and collecting a part of the liquid. For this reason, it may be preferable that the material of the support member 2030 has a high flatness and can be bonded to the recording element substrate 2010 with sufficient reliability. The material of the support member 2030 may be preferably, for example, alumina (aluminum oxide) or a resin material.

Next, the effect of the liquid ejection head of the present embodiment will be described with reference to a comparative example.

Figure 3A:
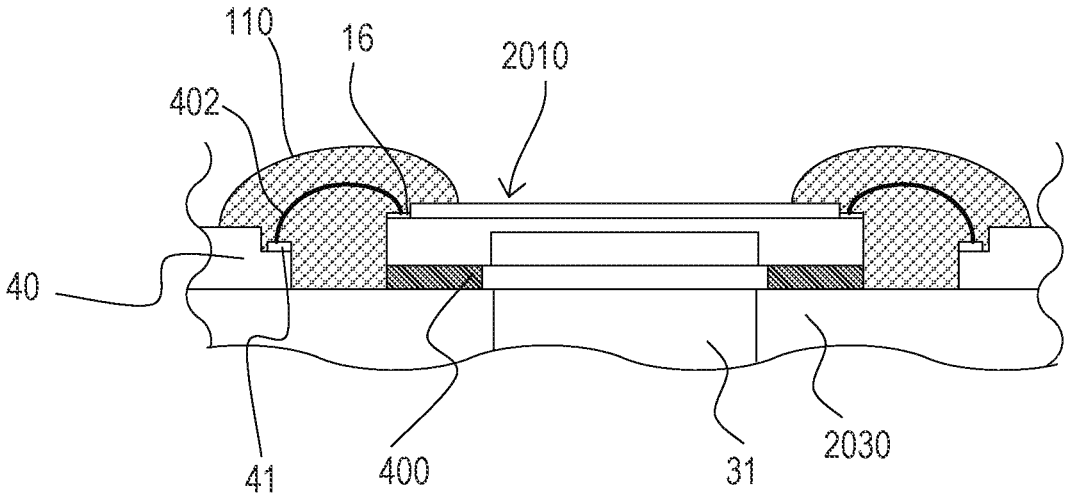
FIGS. 3A and 3B are schematic views showing the bonding structures of comparative examples.

FIG. 3A is a schematic view showing an adhesive structure of the first comparative example. In the adhesive structure of the first comparative example, there is no second adhesive portion 401, and only the first adhesive portion 400 bonds the recording element substrate 2010 and the support member 2030. The first adhesive portion 400 contacts the sealing member 110. The end surface of the sealing member 110 on the side of the first adhesive portion 400 is provided to be flush with the side surface of the end portion of the recording element substrate 2010. The elastic modulus of sealing member 110 and the elastic modulus of first adhesive portion 400 were both high.

Figure 3B:
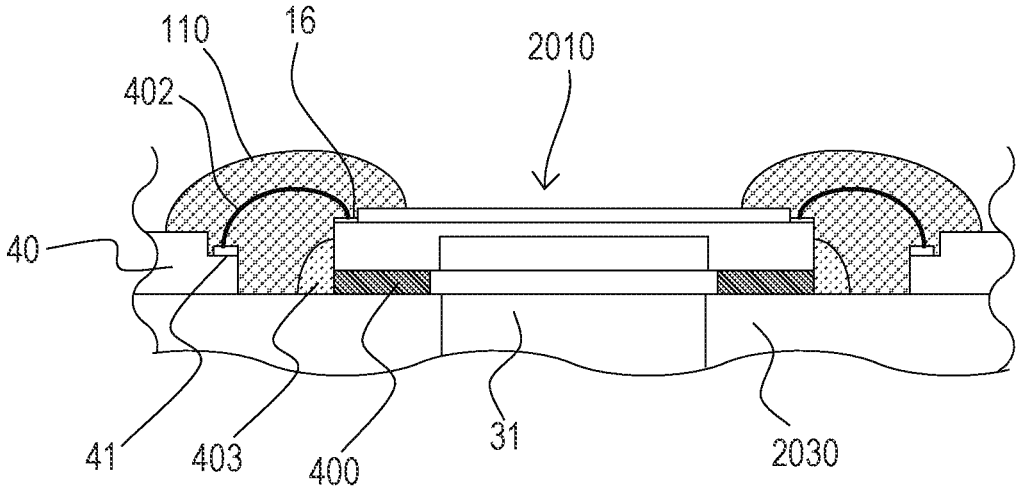

FIG. 3B is a schematic view showing an adhesive structure of the second comparative example. The adhesive structure of the second comparative example is the adhesive structure of the first comparative example plus an auxiliary adhesive portion 403. The auxiliary adhesive portion 403 covers the end surface of the first adhesive portion 400 and a part of the side surface of the end portion of the recording element substrate 2010. The elastic modulus of the auxiliary adhesive portion 403 is less than the elastic modulus of the sealing member 110 and also less than the elastic modulus of the first adhesive portion 400.

In the first comparative example and the second comparative example, the following problem occurs when the sealing member 110 having a high elastic modulus is used.

The coefficient of thermal expansion of recording element substrate 2010 is different from the coefficient of thermal expansion of support member 2030. Therefore, when a temperature change occurs in the recording element substrate 2010 and the support member 2030, strong stress is generated in the contact surface between the sealing member 110 and the recording element substrate 2010 and the contact surface between the sealing member 110 and the support member 2030. As a result, recording element substrate 2010, which has a lower mechanical strength than support member 2030, is susceptible to crack. For example, when the recording element substrate 2010 is composed of a silicon substrate, a crack susceptibly occurs at an edge portion of the end portion of the recording element substrate 2010. Here, the coefficient of thermal expansion indicates the rate of expansion in the length or volume of the object due to the temperature rise per degree.

In addition, in case that the elastic modulus of the first adhesive portion 400 for bonding the recording element substrate 2010 and the support member 2030 is small, the recording element substrate 2010 largely moves with respect to the support member 2030 when the above temperature change occurs. As a result, strong stress occurs in the contact surface between the sealing member 110 and the recording element and the contact surface between the sealing member 110 and the support member 2030.

In the adhesive structure of the first comparative example, when the elastic modulus of the first adhesive portion 400 is high, the entire end portion (including the edge portion) of the recording element substrate 2010 is covered with materials (first adhesive portion 400 and sealing member 110) having high rigidity. As a result, when the above temperature change occurs, strong stress is generated in the edge portion of the end portion of the recording element substrate 2010 due to the difference in the coefficient of thermal expansion between the recording element substrate 2010 and the support member 2030.

On the other hand, in the adhesive structure of the second comparative example, because the auxiliary adhesive portion 403 partially functions as a buffer material, even if the elastic modulus of the first adhesive portion 400 is high, the entire end portion of the recording element substrate 2010 is not covered with a material of high rigidity. However, the edge portion of the end portion of the recording element substrate 2010 on the side of the support member 2030, which is most likely to be stressed, is fixed to the support member 2030 with the first adhesive portion 400 having a high elastic modulus. As a result, a strong stress is generated at the edge portion.

In addition, the sealing member 110 mechanically protects the electrically connecting member 402, the terminal 16 of the recording element substrate 2010, and the terminal 41 of the flexible wiring substrate 40, and further protects against liquid corrosion. In this sealing structure, it is not preferable for the auxiliary adhesive portion 403 to be exposed. Therefore, also in the adhesive structure of the second comparative example, the sealing member 110 covers the auxiliary adhesive portion 403 and firmly fixes the recording element substrate 2010 onto the support member 2030. At the edge portion of the end portion of the recording element substrate 2010 which is fixed by the sealing member 110 as above, strong stress occurs due to the difference in the coefficient of thermal expansion between the recording element substrate 2010 and the support member 2030 when the above temperature change occurs.

In addition to the first comparative example and the second comparative example, there may be a configuration in which a space is formed between the sealing member 110 and the support member 2030. However, as in the case with the auxiliary adhesive portion 403, it is necessary to cover the space with the sealing member 110 from an electrical viewpoint, and it is difficult to form such a configuration.

According to the liquid ejection head of the present embodiment, against the first comparative example and the second comparative example, the edge portion on the support member 2030 side of the end portion 500 of the recording element substrate 2010, which is most likely to be stressed, is bonded to the support member 2030 via the second adhesive portion 401 having a low elastic modulus. Therefore, the end portion 500 of the recording element substrate 2010 can move easily with respect to the support member 2030. Therefore, when temperature changes occur in the recording element substrate 2010 and the support member 2030, it is possible to reduce stress generated in the edge portion due to the difference in the coefficient of thermal expansion between the recording element substrate 2010 and the support member 2030.

FIGS. 4A and 4B show results of comparing the liquid ejection head of the present embodiment with the first comparative example and the second comparative example in terms of the susceptibility to crack. FIG. 4A shows the types of adhesive agents and the sealing member used in the experiment, and FIG. 4B shows the experimental results.

As shown in FIG. 4A, in the liquid ejection head of the present embodiment, an acid anhydride curable epoxy resin having a high filler filling rate was used for the sealing member 110 and the first adhesive portion 400, and an amine epoxy resin was used for second adhesive portion 401. In the first comparative example, an acid anhydride curable epoxy resin having a high filler filling rate was used for the sealing member 110 and the first adhesive portion 400. In the second comparative example, an ACID anhydride curable epoxy resin having a high filler filling ratio was used for the sealing member 110 and the first adhesive portion 400, and an amine epoxy resin was used for auxiliary adhesive portion 403. The major physical properties of the first adhesive portion 400, the second adhesive portion 401, the sealing member 110, and the auxiliary adhesive portion 403 are shown in FIG. 4A.

Under the conditions shown in FIG. 4A, thermal shock tests were performed on the liquid ejection heads of the present embodiment, the first comparative example and the second comparative example respectively. The thermal shock test condition was a cycle test of 30 minutes at minus 70° C. and 30 minutes at plus 130° C. As a result, as shown in FIG. 4B, cracks occurred in all the samples of the first comparative example and the second comparative example after 50 cycles and 60 cycles, respectively. On the other hand, in the liquid ejection head of the present embodiment, no crack occurred in any of the samples even after 100 cycles.

As described above, in the liquid ejection head of the present embodiment, the adhesive layer 4000 disposed between the recording element substrate 2010 and the support member 2030 has the first adhesive portion 400 and the second adhesive portion 401. The second adhesive portion 401 is provided closer to the sealing member 110 than the first adhesive portion 400. The rigidity (or elastic modulus) of the second adhesive portion 401 is less than the respective rigidity (or elastic modulus) of the first adhesive portion 400 and the sealing member 110. With such a structure, stress generated at the end portion 500 of the recording element substrate 2010 can be reduced, and generation of a crack in the recording element substrate 2010 can be suppressed.

Figure 5:
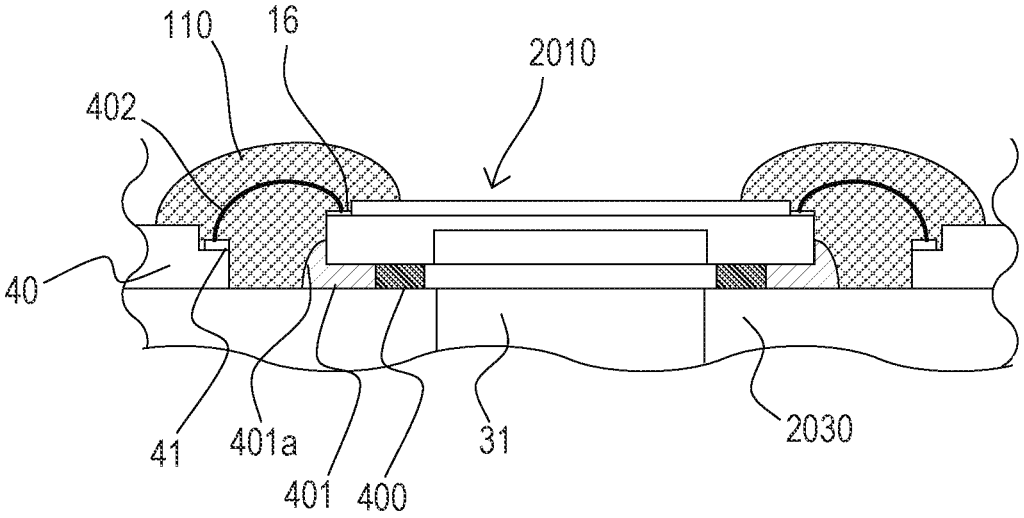
FIG. 5 is a diagram showing a first modified example of the liquid ejection head shown in FIGS. 2A to 2C.

In the liquid ejection head of the present embodiment, the following modifications can be made. FIG. 5 is a diagram showing a first modified example of the liquid ejection head of the present embodiment. The second adhesive portion 401 has a protruding portion 401*a* protruding to the sealing member 110 side from the end surface of the recording element substrate 2010. The protruding portion 401*a* covers a portion of the end surface of recording element substrate 2010. By providing the above protruding portion 401*a*, the edge portion of the end portion of the recording element substrate 2010 on the support member 2030 side, which is most likely to be stressed, can be reliably covered with the second adhesive portion 401 having a low elastic modulus. Therefore, the stress generated at the edge portion can be reduced due to the difference in the coefficient of thermal expansion between the recording element substrate 2010 and the support member 2030, and the occurrence of crack in the recording element substrate 2010 can be further suppressed.

Figure 6A:
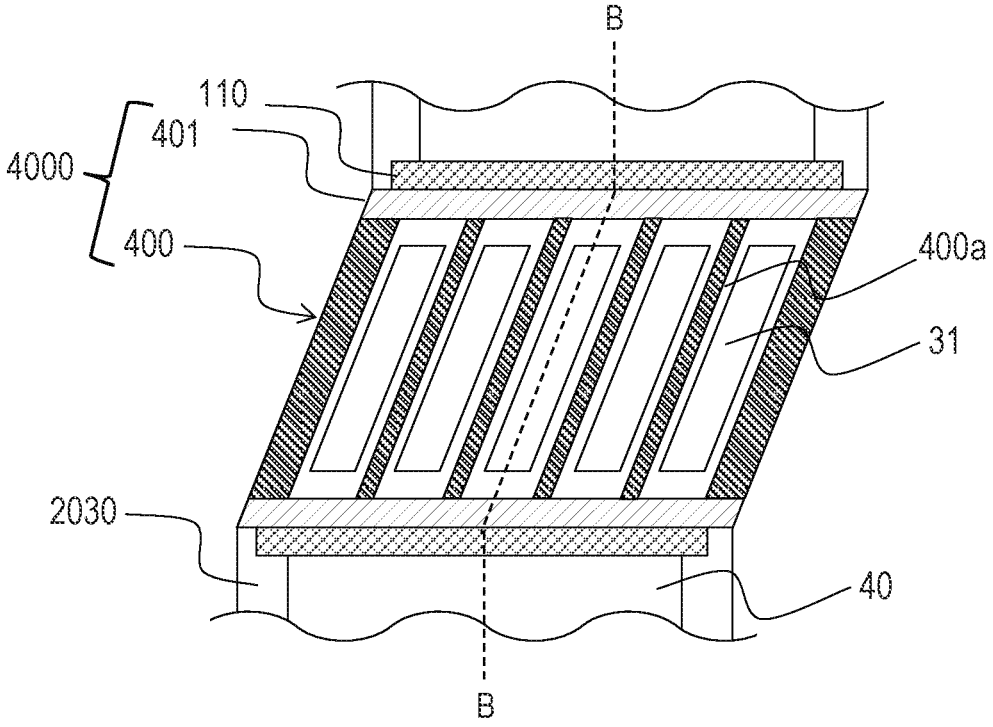
FIGS. 6A and 6B are diagrams showing a second modified example of the liquid ejection head shown in FIGS. 2B and 2C.
Figure 6B:
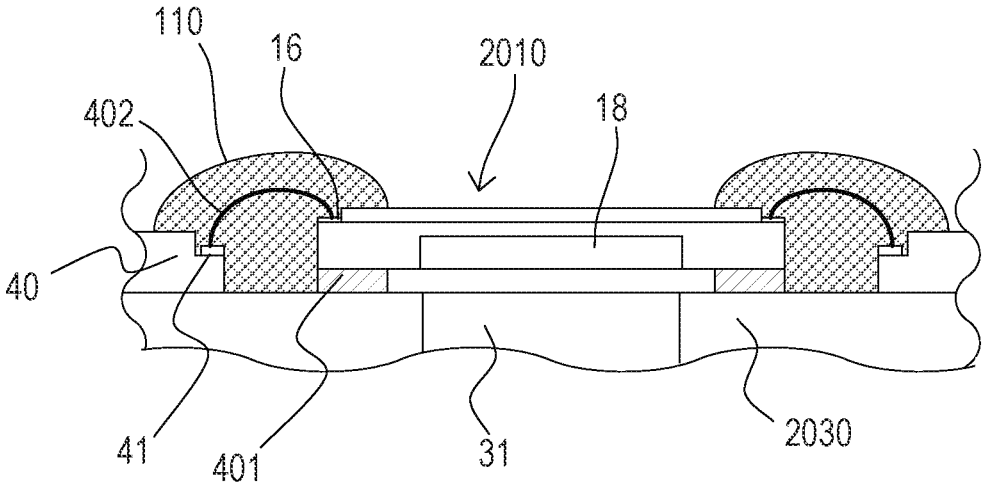

FIGS. 6A and 6B are diagrams showing a second modified example of the liquid ejection head of the present embodiment. FIG. 6A is a plan view showing an adhesive layer 4000 bonding the recording element substrate 2010 and the support member 2030. FIG. 6B is a sectional view taken along a broken line B-B in FIG. 6A.

As shown in FIGS. 6A and 6B, the support surface 2030*a* of the support member 2030 is provided with multiple liquid supply orifices 31 for supplying liquid to the recording element substrate 2010. The first adhesive portion 400 and the second adhesive portion 401 are formed to surround the liquid supply orifice 31. Thus, according to the structure in which the first adhesive portion 400 and the second adhesive portion 401 surround the liquid supply orifice 31, the recording element substrate 2010 can be reliably bonded to the support surface 2030*a* of the support member 2030.

The second adhesive portion 401 extends along the end portion of the recording element substrate 2010. The first adhesive portion 400 has multiple belt-shaped adhesive portions 400*a*. Each of the belt-shaped adhesive portions 400*a* extends in a direction intersecting the longitudinal direction of the second adhesive portion 401. Multiple liquid supply orifices 31 are provided. Belt-shaped adhesive portions 400*a* and liquid supply orifices 31 are alternately arranged. According to this structure, the first adhesive portion 400 with high elastic modulus is separated into multiple belt-shaped adhesive portions 400*a* in a direction along the end portion of the recording element substrate 2010 which is likely to be stressed. This separation can further reduce the stress at the edge portion due to the difference in the coefficient of thermal expansion between the recording element substrate 2010 and the support member 2030.

The liquid ejection head of the second modified example was subjected to the same test as the thermal shock test described above. The sample with the first adhesive portion 400 which is not separated into belt-shaped adhesive portions 400*a* could crack after 120 cycles. In contrast, the sample with the first adhesive portion 400 which is separated into belt-shaped adhesive portions 400*a* did not crack even after 200 cycles.

Note that the second adhesive portion 401 does not necessarily have to be provided between the sealing member 110 and the first adhesive portion 400 over the entire area. Some belt-shaped adhesive portions 400*a* may protrude to the sealing member 110 with beyond the second adhesive portion 401. Also in this case, since the first adhesive portion 400 is separated into multiple belt-shaped adhesive portions 400*a*, the stress is dispersed, so that the occurrence of cracks can be suppressed.

According to the liquid ejection head of the second modified example, the first adhesive portion 400 is separated into the belt-shaped adhesive portions 400*a* in the space surrounded by the liquid supply passage 31 of the support member 2030, the supply passage 18 of the recording element substrate 2010 and the sealing members 110, thereby achieving the following effects.

In the adhesive layer 4000 shown in FIGS. 2A to 2C, when bonding the recording element substrate 2010 and the support member 2030, bubbles may be entrained between the first adhesive portion 400 and the second adhesive portion 401. If the air bubbles expand to create voids in the adhesive layer 4000 during curing of the adhesive agent, the liquid may leak from the liquid flow passage. In contrast, according to the second modified example, by separating the first adhesive portion 400 into the belt-shaped adhesive portions 400*a*, it is possible to reduce the entrainment of bubbles when the recording element substrate 2010 and the support member 2030 are bonded. As a result, liquid leakage from the liquid flow passage can be suppressed.

The first adhesive portion 400 and the second adhesive portion 401 are not limited to the arrangements described above. The first adhesive portion 400 and the second adhesive portion 401 may be arranged in any manner as long as the occurrence of cracks can be suppressed. Several patterns of structure in which the first adhesive portion 400 and the second adhesive portion 401 surround the liquid supply orifice 31 in a planer view of the liquid ejection head are described below.

Figure 7A:
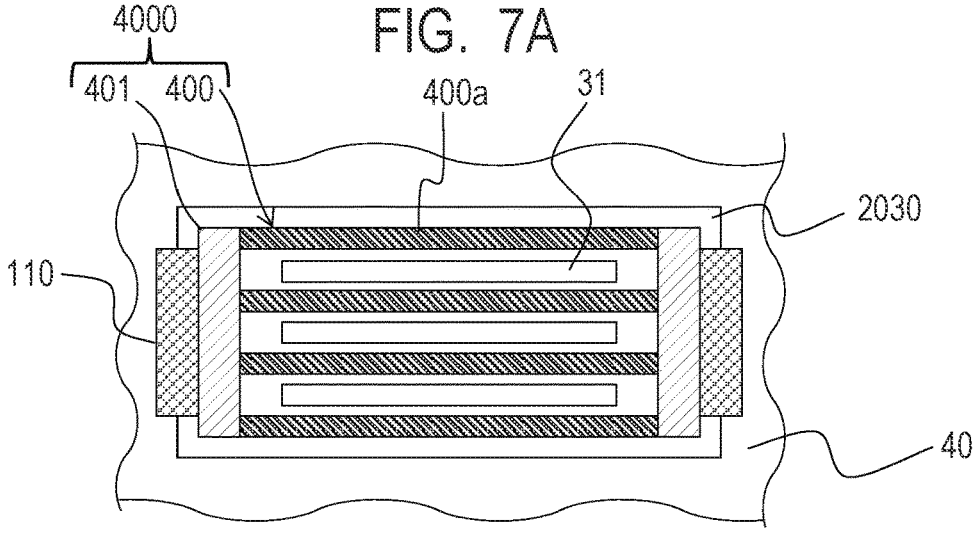
FIGS. 7A, 7B and 7C are diagrams for explaining an example arrangement of a first adhesive portion and a second adhesive portion of the liquid ejection head shown in FIGS. 2A to 2C.
Figure 7B:
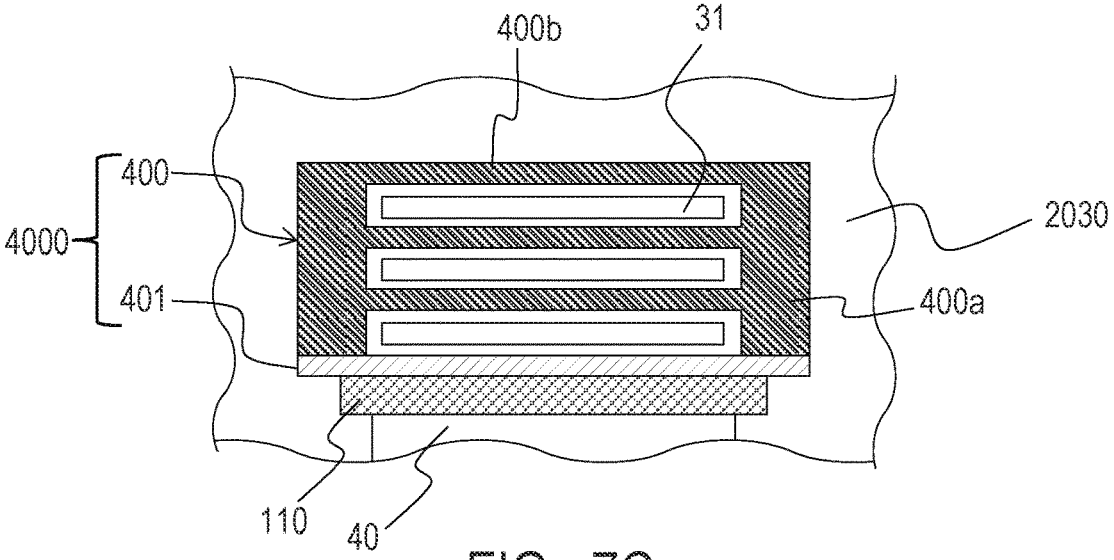
Figure 7C:
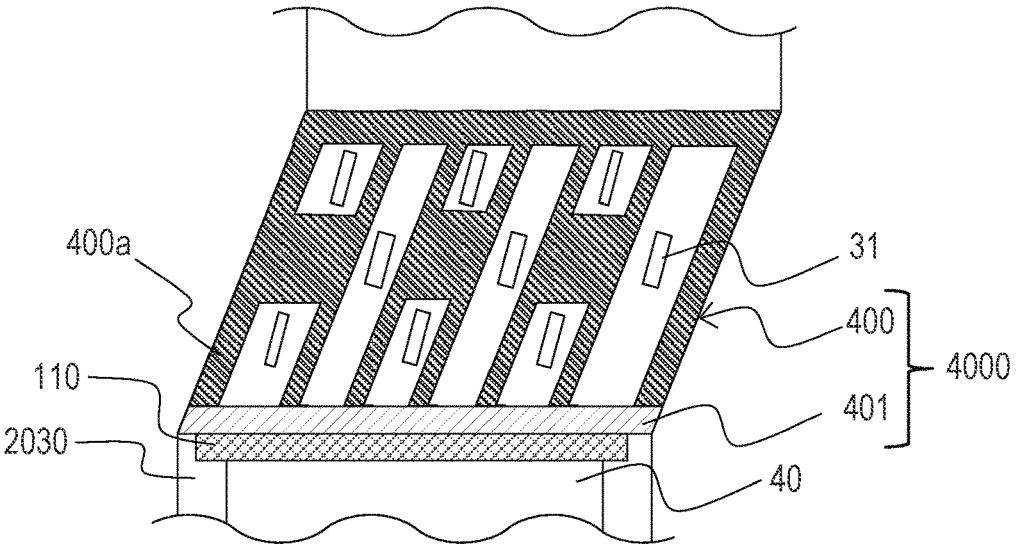

FIGS. 7A to 7C are diagrams for explaining an example arrangement of the first adhesive portion 400 and the second adhesive portion 401. FIG. 7A shows an example of the adhesive layer 4000 to bond the recording element substrate 2010 of which outer-shape is a rectangular and which has terminals 16 at both end portions thereof to the support member 2030 The support member 2030 includes multiple liquid supply orifices 31 for supplying liquid to the recording element substrate 2010. The first adhesive portion 400 and the second adhesive portion 401 are formed to surround the liquid supply orifice 31. The second adhesive portion 401 extends along the end portion of the recording element substrate 2010. Each of the liquid supply orifices 31 extends in a direction intersecting the longitudinal direction of the second adhesive portion 401. The first adhesive portion 400 consists of multiple belt-shaped adhesive portions 400*a*. Each of the belt-shaped adhesive portions 400*a* extends in a direction intersecting the longitudinal direction of the second adhesive portion 401. The belt-shaped adhesive portions 400*a* and the liquid supply orifices 31 are arranged alternately.

FIG. 7B shows an example of the adhesive layer 4000 to bond the recording element substrate 2010 of which outer-shape is a rectangular and which has terminals 16 at one end portion thereof to the support member 2030. The second adhesive portion 401 extends along the end portion of the recording element substrate 2010. Each of the liquid supply orifices 31 extends in a direction parallel to the longitudinal direction of the second adhesive portion 401. The first adhesive portion 400 has two belt-shaped adhesive portions 400*a* extending in a direction intersecting the longitudinal direction of the second adhesive portion 401 and multiple belt-shaped adhesive portions 400*b* provided between the belt-shaped adhesive portions 400*a* and extending in a direction parallel to the longitudinal direction of the second adhesive portion 401. One end of each of the belt-shaped adhesive portions 400*a* is connected to the second adhesive portion 401. Belt-shaped adhesive portions 400*b* and liquid supply orifices 31 are alternately arranged. One end of each of the belt-shaped adhesive portions 400*b* is connected to one belt-shaped adhesive portion 400*a* and the other end is connected to the other belt-shaped adhesive portion 400*a*.

FIG. 7C shows an example of the adhesive layer 4000 to bond the recording element substrate 2010 of which outer-shape is a parallelogram and which has terminals 16 at one end portion thereof to the support member 2030. Here, the parallelogram has an obtuse vertex and an acute vertex. In the support member 2030, liquid supply orifices 31 for supplying liquid to the recording element substrate 2010 are arranged alternately. The first adhesive portion 400 and the second adhesive portion 401 are formed to surround the liquid supply orifice 31. The connection portion of the first adhesive portion 400 with the second adhesive portion 401 consists of multiple belt-shaped adhesive portions 400*a*.

The liquid ejection head of the present disclosure described above may preferably be applied in the following cases.

When the outer-shape of the recording element substrate 2010 is a parallelogram having an obtuse vertex and an acute vertex, due to the difference between the coefficient of thermal expansion of the recording element substrate 2010 and the support member 2030, the recording element substrate 2010 tries to deform so as to rotate in parallel to the joint plane with respect to the support member 2030. Therefore, stronger stress is generated at the edge portion of the end portion near the acute vertex of the recording element substrate 2010, and a crack of the recording element substrate 2010 is likely occurred. In such a case the occurrence of cracks in the recording element substrate 2010 can be suppressed by applying the liquid ejection head of the present disclosure.

If terminals 16 are formed at both end portions of the recording element substrate 2010, sealing members 110 with high elastic modulus fix both end portions of the recording element substrate 2010 to support member 2030. Therefore, stronger stress is generated at the edge portion of the end portion near the acute vertex of the recording element substrate 2010, and a crack of the recording element substrate 2010 is likely generated. In such a case, the occurrence of a crack in the recording element substrate 2010 can be suppressed by applying the liquid ejection head of the present disclosure.

Further, in a configuration in which the liquid ejection head controls the temperature of the recording element substrate 2010 to perform high-quality ejection, a large thermal change is repeatedly applied to the recording element substrate 2010 and the support member 2030. As a result, a crack of the recording element substrate 2010 is likely to occur. In such a case, the liquid ejection head of the present disclosure can be applied to suppress the occurrence of a crack in the recording element substrate 2010.

In addition, to protect the electrically connecting member 402, the terminal 16 and the terminal 41 mechanically and also to protection them from liquid corrosion, it may be preferable to set the curing temperature of the sealing member 110 higher. For example, the curing temperature may be preferably 150° C. or higher. However, when the curing temperature is raised to a high temperature, the thermal stress when the sealing member 110 cured at the curing temperature returns to the normal temperature becomes larger, and a crack of the recording element substrate 2010 is likely to occur. Also in this case, the liquid ejection head of the present disclosure can be applied to suppress the occurrence of a crack in the recording element substrate 2010. Further, in the case where frequent and long-term use is required, for example for industrial applications, the recording element substrate 2010 and the support member 2030 repeatedly undergo large thermal changes. As a result, a crack in the recording element substrate 2010 is likely to occur. Also in this case, the liquid ejection head of the present disclosure can be applied to suppress the occurrence of a crack in the recording element substrate 2010.

Further, it may be preferable that the first adhesive agent of the first adhesive portion 400 and the second adhesive agent of the second adhesive portion 401 are both heat-curable materials, and the curing temperature of the second adhesive agent is lower than the curing temperature of the first adhesive agent. In order to strongly bond the recording element substrate 2010 to the support member 2030, the adhesive agent may be a thermosetting adhesive agent and has a high curing temperature in some cases. However, when the recording element substrate 2010 is bonded to the support member 2030 with an adhesive agent which cures at a high temperature, the relative positional relationship between the recording element substrate 2010 and the support member 2030 changes after the temperature returns to normal because the linear expansion coefficients of the members are different from each other. To the problem, in general, another adhesive agent having a lower curing temperature is used as an auxiliary agent for temporal fixation at a lower temperature to achieve both high adhesive strength and high placement accuracy. However, in order to effectively protect the side with the electrically connecting portion where the electrically connecting portion is located, it is not desirable to place an adhesive agent for temporal fixation on the side of the recording element substrate 2010 such exemplified by the auxiliary adhesive portion 403 in FIG. 3B. To the problem, in the shape of the adhesive layer 4000 shown in FIGS. 2A to 2C, an adhesive agent for temporary fixing having a low curing temperature can be used for the second adhesive portion 401. Specifically, an adhesive agent having a high curing temperature and a high adhesive strength is used for the first adhesive portion 400, and an adhesive agent for temporary fixing having a low curing temperature is used for the second adhesive portion 401. Thus, the temporary fixing can be performed while effectively protecting the electrically connecting portion with high adhesive strength. As described above, in the shape of the adhesive layer 4000 shown in FIGS. 2A to 2C, when the recording element substrate 2010 and the support member 2030 are bonded, bubbles may be entrained between the first adhesive portion 400 and the second adhesive portion 401. On the other hand, if the second modified example shown in FIGS. 6A and 6B is used, it is possible to perform temporary fixing without entraining bubbles. Examples of the adhesive agent and sealing member include a combination of materials as shown in FIG. 4A. Thus, by using the material in which the curing temperature of the second adhesive agent is lower than that of the first adhesive agent, the bonding position of the recording element substrate 2010 and the support member 2030 can be maintained with high accuracy while preventing the occurrence of a crack in the recording element substrate 2010.

The above-described configuration does not limit the scope of the present disclosure. A thermal system for ejecting liquid by generating bubbles by a heating element has been described as an example but the present disclosure can also be applied to liquid ejection head adopting a piezo system or other various liquid ejecting systems.

Further, the present disclosure can be applied to a so-called line type head having a length corresponding to the width of a recording medium or a so-called serial type liquid ejection head for performing recording while scanning a recording medium.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-196092, filed Nov. 26, 2020, and Japanese Patent Application No. 2021-050143, filed Mar. 24, 2021, which are hereby incorporated by reference herein in their entirety.

What is claimed is:

1. A liquid ejection head comprising:

a recording element substrate for ejecting liquid;

a support member for supporting the recording element substrate;

an adhesive layer provided between the recording element substrate and the support member;

a first electrically connecting portion provided at an end portion of the recording element substrate; and a sealing member covering the end portion of the recording element substrate including the first electrically connecting portion, wherein the sealing member is in contact with a side surface of the end portion of the recording element substrate and an end surface of the adhesive layer, wherein the adhesive layer comprises:

a first adhesive portion; and a second adhesive portion positioned between the first adhesive portion and the sealing member, wherein rigidity of the second adhesive portion is less than rigidity of the sealing member and less than rigidity of the first adhesive portion, wherein the support member comprises a liquid supply orifice for supplying the liquid to the recording element substrate on a support surface for supporting the recording element substrate, and wherein the first adhesive portion and the second adhesive portion are formed to surround the liquid supply orifice in a planer view of the liquid ejection head, and the first adhesive portion has multiple belt-shaped adhesive portions, the support member comprises multiple liquid supply orifices, and the belt-shaped adhesive portions and the liquid supply orifices are alternately arranged.

2. The liquid ejection head according to claim 1, wherein a contact surface of the second adhesive portion with the sealing member is provided so as to be flush with the side surface of the end portion of the recording element substrate.

3. The liquid ejection head according to claim 1, wherein the second adhesive portion includes a protruding portion which protrudes from the side surface of the end portion of the recording element substrate toward the sealing member.

4. The liquid ejection head according to claim 3, wherein the protruding portion covers a part of the side surface of the end portion of the recording element substrate.

5. The liquid ejection head according to claim 1, wherein the second adhesive portion extends along the end portion of the recording element substrate and the belt-shaped adhesive portions extend in a direction intersecting a longitudinal direction of the second adhesive portion in the planer view of the liquid ejection head.

6. The liquid ejection head according to claim 1, wherein the second adhesive portion extends along the end portion of the recording element substrate and the belt-shaped adhesive portions extend in a direction parallel to the longitudinal direction of the second adhesive portion.

7. The liquid ejection head according to claim 1, wherein the support member comprises a liquid supply orifice for supplying the liquid to the recording element substrate on a support surface supporting the recording element substrate, and wherein the first adhesive portion is closer to the liquid supply orifice than the second adhesive portion.

8. The liquid ejection head according to claim 1, wherein a coefficient of thermal expansion of the recording element substrate is different from a coefficient of thermal expansion of the support member.

9. A liquid ejection head comprising:

a recording element substrate for ejecting liquid;

a support member for supporting the recording element substrate;

an adhesive layer provided between the recording element substrate and the support member;

a wiring substrate;

a first electrically connecting portion provided at an end portion of the recording element substrate;

a second electrically connecting portion formed at an end of the wiring substrate;

an electrically connecting member for electrically connecting the first electrically connecting portion and the second electrically connecting portion; and a sealing member covering the end portion of the recording element substrate including the first electrically connecting portion, wherein the sealing member is in contact with a side surface of the end portion of the recording element substrate and an end surface of the adhesive layer, wherein the wiring substrate is fixed to the support member such that the end portion of the wiring substrate is adjacent to the end portion of the recording element substrate, wherein the adhesive layer comprises:

a first adhesive portion; and a second adhesive portion positioned between the first adhesive portion and the sealing member, wherein rigidity of the second adhesive portion is less than rigidity of the sealing member and less than rigidity of the first adhesive portion, wherein the sealing member further covers the end portion of the wiring substrate including the second electrically connecting portion and the electrically connecting member.

10. The liquid ejection head according to claim 1, wherein the recording element substrate is formed by a silicon substrate and the support member is formed by aluminum oxide.

11. The liquid ejection head according to claim 1, wherein the shape of the recording element substrate is a parallelogram having an obtuse vertex and an acute vertex.

12. A liquid ejection head comprising:

a recording element substrate for ejecting liquid;

a support member for supporting the recording element substrate;

an adhesive layer provided between the recording element substrate and the support member;

a first electrically connecting portion provided at an end portion of the recording element substrate; and a sealing member covering the end portion of the recording element substrate including the first electrically connecting portion, wherein the sealing member is in contact with a side surface of the end portion of the recording element substrate and an end surface of the adhesive layer, wherein the adhesive layer comprises:

a first adhesive portion; and a second adhesive portion positioned between the first adhesive portion and the sealing member, and further wherein a first adhesive agent constituting the first adhesive portion and a second adhesive agent constituting the second adhesive portion are both thermally curable materials, and a curing temperature of the second adhesive agent is lower than a curing temperature of the first adhesive agent.

13. The liquid ejection head according to claim 12, wherein the second adhesive portion includes a protruding portion which protrudes from the side surface of the end portion of the recording element substrate toward the sealing member.

14. The liquid ejection head according to claim 13, wherein the protruding portion covers a part of the side surface of the end portion of the recording element substrate.

15. The liquid ejection head according to claim 12, wherein the support member comprises a liquid supply orifice for supplying the liquid to the recording element substrate on a support surface for supporting the recording element substrate, and wherein the first adhesive portion and the second adhesive portion are formed to surround the liquid supply orifice in a planer view of the liquid ejection head.

16. The liquid ejection head according to claim 15, wherein the first adhesive portion has multiple belt-shaped adhesive portions, the support member comprises multiple liquid supply orifices, and the belt-shaped adhesive portions and the liquid supply orifices are alternately arranged.

17. The liquid ejection head according to claim 12, wherein the support member comprises a liquid supply orifice for supplying the liquid to the recording element substrate on a support surface supporting the recording element substrate, and wherein the first adhesive portion is closer to the liquid supply orifice than the second adhesive portion.

18. The liquid ejection head according to claim 1, wherein the first adhesive portion comprises fillers.

19. The liquid ejection head according to claim 1, wherein the first adhesive portion and the second adhesive portion comprise epoxy resin.

* * * * *